US006241487B1

(12) United States Patent
Reynolds

(10) Patent No.: US 6,241,487 B1
(45) Date of Patent: Jun. 5, 2001

(54) FLUID POWERED DIAPHRAGM PUMP

(75) Inventor: Steven M. Reynolds, Lucas, OH (US)

(73) Assignee: Warren Rupp, Inc., Mansfield, OH (US)

( * ) Notice: Subject to any disclaimer, the term of this patent is extended or adjusted under 35 U.S.C. 154(b) by 0 days.

(21) Appl. No.: 09/189,436

(22) Filed: Nov. 10, 1998

(51) Int. Cl.[7] ..... F04B 43/06; F04B 17/00; E03B 31/00

(52) U.S. Cl. ..... 417/395; 417/393; 137/625.6

(58) Field of Search ..... 417/393, 395; 137/625.6, 625.11

(56) References Cited

U.S. PATENT DOCUMENTS

| | | | | |
|---|---|---|---|---|
| 3,766,935 | * | 10/1973 | Clippard | 137/269 |
| 3,847,511 | | 11/1974 | Cole | 417/342 |
| 3,973,581 | * | 8/1976 | Chiba | 137/116 |
| 4,543,044 | | 9/1985 | Simmons | 417/342 |
| 4,651,625 | * | 3/1987 | Hoge | 91/461 |
| 4,749,058 | * | 6/1988 | Trainor | 181/239 |
| 4,856,969 | * | 8/1989 | Forsythe et al. | 417/395 |
| 4,902,206 | | 2/1990 | Nakazawa et al. | 417/394 |
| 4,983,104 | | 1/1991 | Kingsford et al. | 417/473 |
| 5,141,412 | | 8/1992 | Meinz | 417/473 |
| 5,219,038 | * | 6/1993 | Hamada et al. | 180/248 |
| 5,224,841 | | 7/1993 | Thompson et al. | 417/392 |
| 5,232,352 | * | 8/1993 | Robinson | 417/393 |
| 5,255,555 | | 10/1993 | Robinson | 417/393 |
| 5,257,914 | * | 11/1993 | Reynolds | 417/293 |
| 5,277,555 | * | 1/1994 | Robinson | 417/393 |
| 5,332,372 | | 7/1994 | Reynolds | 417/393 |
| 5,497,804 | * | 3/1996 | Codina et al. | 137/554 |
| 5,551,847 | * | 9/1996 | Gardner et al. | 417/393 |
| 5,851,109 | * | 12/1998 | Reynolds | 417/395 |
| 5,996,627 | * | 12/1999 | Reynolds | 137/625.6 |

FOREIGN PATENT DOCUMENTS

| | | |
|---|---|---|
| 733447 | 1/1954 | (GB) . |
| 956847 | 4/1963 | (GB) . |
| WO 90/04106 | 5/1989 | (WO) . |

* cited by examiner

*Primary Examiner*—Timothy S. Thorpe
*Assistant Examiner*—Michael K. Gray
(74) *Attorney, Agent, or Firm*—Barnes & Thornburg

(57) ABSTRACT

A fluid powered diaphragm pump is provided which includes three means for supplementing the pilot valve signal to the main fluid valve spool. The means include a cross porting of the main fluid valve spool, or engineered orifices that communicate pressurized air being delivered to one of the inner diaphragm chambers of the pump to the main fluid valve spool by way of either the intermediate bracket or the pilot valve housing. Design features also include the location of the pilot valve assembly immediately below the pressurized fluid inlet cap and between the inlet cap and the main fluid valve assembly. Further, an integrated exhaust muffler is mounted directly to the main fluid valve housing and the main fluid valve housing includes a segmented sleeve assembly which makes it easier to service the main fluid valve assembly and, specifically, the main fluid valve spool. Further, proximity sensors are provided at either end of the main fluid valve spool and an interface is provided to connect the pump to electronic monitoring equipment.

22 Claims, 11 Drawing Sheets

FLUID POWERED DIAPHRAGM PUMP

FIELD OF THE INVENTION

The present invention relates generally to pumps and, more specifically, to fluid powered diaphragm pumps. Still more specifically, the present invention relates to design improvements which reduce stalling and sticking of the main fluid valve, which enhance the serviceability of the pump, which improve the efficiency of the exhaust system of the pump and which enable the pump to be easily interfaced with electronic equipment.

BACKGROUND OF THE INVENTION

Fluid powered diaphragm pumps are known. A typical design sold under the SANDPIPER® trademark by Warren Rupp, Inc., a unit of IDEX Corporation, of Mansfield, Ohio is shown in FIG. 1. Specifically, the pump 10 includes two chambers 11, 12 which are defined by the diaphragms 13, 14. The diaphragms 13, 14 are connected by a diaphragm rod 15 by way of the diaphragm plate assemblies 16, 17. Pressurized fluid is supplied to the inner diaphragm chambers 18, 19 by way of a main fluid valve 21. The main fluid valve 21 includes a spool 22 that is slidably accommodated in a housing 23. The housing 23 may also be equipped with a sleeve-like structure 24 that accommodates the spool 22. The spool 22 slides back and forth from left to right in the housing 23 and directs pressurized fluid into the inner diaphragm chambers 18, 19 in a reciprocating fashion. The spool 22, or the main fluid valve 21 is shifted by a pilot valve which is not shown in FIG. 1. Typical prior art pilot valves are powered by air bled off of the pressurized fluid supply which drives the pump. This design has been found to be problematic for the following reasons.

Specifically, when the pump 10 is operating at low speeds or with a pressurized fluid supply at a relatively low pressure, the pilot valve can be starved for power as the pump 10 consumes the bulk of the pressurized supply fluid. Accordingly, the pilot valve may not shift properly and, accordingly, will not direct a sufficient amount of pressurized fluid to either opposing end 25, 26 to properly shift the spool 22 of the main fluid valve 21. Therefore, there is a need for an improved fluid diaphragm pump which avoids the problem associated with the shifting of the pilot valve, and consequently the shifting of the main fluid valve, when the pump is operating with a pressurized fluid supply of a reduced pressure.

Two other problems associated with the operation of fluid powered diaphragm pumps are stalling and sticking. Stalling typically occurs when the pump is operated at low speeds or at a low pressure differential. Stalling can also occur when the main fluid valve components are worn thereby allowing internal fluid leakage or by-pass. In any event, the spool 22 of the main fluid valve 21 becomes stuck at a midpoint between the first and second positions, or left and right positions, and the only reliable means for restarting the pump requires the operator to shut off the pressurized fluid supply and restart the pressurized fluid supply. Typically, operators in this field will attempt to restart the pump by banging on the main fluid valve housing with a hammer or other heavy object, which can damage the pump. This solution is also ineffective because the spool of the pilot valve, along with the spool of the main fluid valve, is typically located at a midpoint between the two shifted positions. The location of the spool of the main fluid valve in the mid-point position diverts or blocks off the supply fluid and prevents the pump from reciprocating.

Stalling is normally associated when the discharge fluid is compressible or includes air or vapor which results in a lower pressure head. As the discharge fluid is compressed and decompressed in the diaphragm chambers, the pilot valve is pulsed, rather than positively shifted, eventually resulting in the building up of balanced air pressures on either side of the pilot valve spool as well as the main fluid valve spool, causing both spools to obtain a centered position in their respective housings. Stalling can also occur with low flow and low speed applications such as the employment of a diaphragm pump in a filter press or in connection with an on-demand spray service. Both applications have low speed and low flow coupled with a low head or dead head. Both applications can also create air or vapor build-up on the discharge side of the pump.

As a result, there is a need for an improved fluid powered diaphragm pump which results in a positive shift of both the pilot valve spool and main fluid valve spool in low speed, low pressure applications.

A pump is considered to be sticking when it fails to restart or stops in the middle of a stroke. Typically, the main fluid valve spool is seized or stuck in the sleeve or housing. This situation occurs most frequently when the pressurized fluid is contaminated or is of a poor quality. Sticking frequently occurs when diaphragm pumps are employed in mines and the pressurized fluid is a poor quality air supply. Because the main fluid valve spool is typically disposed within a solid sleeve structure that, in turn, is attached to the valve housing, it is very difficult to service the main fluid valves of diaphragm pumps. The entire spool and sleeve must be removed and clean in the event sticking occurs.

Accordingly, there is a need for an improved fluid powered diaphragm pump with a main fluid valve that is easier to disassemble and/or service.

Further, currently available diaphragm pumps typically include inefficient exhaust systems. Exhaust systems are required due to the high noise level associated with these pumps. Further, most diaphragm pumps do not come equipped with a versatile exhaust element, meaning that the pump is equipped with its own exhaust and muffler system or, the pump must be modified if the end users is required to pipe the exhaust away from the pump. Further, many exhaust system designs are difficult to disassemble, and disassembly is required on a relatively frequent basis due to the susceptibility of exhaust systems to freezing.

Further, diaphragm pumps are not easily incorporated into electronic interfaces which monitor the pump frequency. Typically, upgrading an existing pump to be interfaced with electronic manufacturing equipment is time consuming and expensive. Accordingly, there is a need for an improved fluid powered diaphragm pump design which enables the pump to be easily integrated with electronic manufacturing equipment.

Still further, there is a need for an improved fluid powered diaphragm pump which may be easily locked so as to prevent the pump from running accidentally. Currently, the only way to lock out a diaphragm pump is to completely disconnect the pressurized fluid supply.

SUMMARY OF THE INVENTION

The present invention satisfies the aforenoted needs by providing a fluid powered diaphragm pump that comprises a fluid inlet providing communication between a pressurized fluid supply and both a main fluid valve and a pilot valve. The main fluid valve comprises a housing. The pilot valve is disposed between the fluid inlet and the main fluid valve. As a result, the pilot valve is powered directly by the pressurized fluid supply as opposed to bleed fluid. Therefore, the pilot valve is operated as fluid under the same pressure that is used to operate the main fluid valve.

In an embodiment, the main fluid valve further comprises a spool slidably accommodated in a segmented sleeve assembly. The segmented sleeve assembly comprises a plurality of annular sleeve segments or wafers. The annular sleeve segments are fixedly accommodated in the housing. As a result, the sleeve assembly is easily disassembled for servicing of the main fluid valve spool in the event the main fluid valve spool becomes stuck or bound in place. The segmented sleeve assembly enhances the serviceability of the main fluid valve.

In an embodiment, the segmented sleeve assembly further comprises a plurality of spacers. Each spacer is disposed between two of the annular sleeve segments.

In an embodiment, the spool comprises opposing first and second ends. The first end comprises a first actuator pin and the second end comprises a second actuator pin. The annular sleeve segments and the spool are disposed between opposing first and second end caps. The first end cap comprises an aperture for receiving the first actuator pin; the second end cap comprises an aperture for receiving the second actuator pin. The first end cap is connected to a first proximity sensor; the second end cap is connected to a second proximity sensor. The first and second proximity sensors are connected to a controller. As a result of the configuration of the main fluid valve spool and unique end caps, the main fluid valve of the pump of the present invention is easily connected to electronic manufacturing equipment or easily interfaced with a controller or other electronic equipment.

In an embodiment, the spool is shiftable between a first main valve position where the first actuator pin extends past the first proximity sensor and a second main valve position where the second actuator pin extends past the second proximity sensor. The controller may respond to the frequency at which the first actuator pin extends past the first proximity sensor and the frequency at which the second actuator pin extends past the second proximity sensor.

In an embodiment, the main fluid valve housing comprises a threaded exhaust port. The threaded exhaust port is connected to an exhaust muffler. The exhaust muffler is disposed between and enclosed by the main fluid valve housing and a muffler housing. The muffler housing is connected to the main fluid valve housing.

In an embodiment, the present invention provides a fluid powered diaphragm pump that comprises a fluid inlet providing communication between a pressurized fluid supply and both a main fluid valve and a pilot valve. The main fluid valve comprises a spool slidably accommodated in a segmented sleeve assembly. The segmented sleeve assembly comprises a plurality of annular sleeve segments. The annular sleeve segments are fixedly accommodated in the housing.

In an embodiment, the present invention provides a fluid powered diaphragm pump that comprises a fluid inlet providing communication between a pressurized fluid supply and both a main fluid valve and a pilot valve. The main fluid valve comprises a housing. The housing comprises a threaded exhaust port. The threaded exhaust port is connected to an exhaust muffler. The exhaust muffler is disposed between and enclosed by the main fluid valve housing and a muffler housing. The muffler housing is connected to the main fluid valve housing.

In an embodiment, the present invention provides a fluid powered diaphragm pump that comprises a fluid inlet providing communication between a pressurized fluid supply and both a main fluid valve and a pilot valve. The main fluid valve comprises a spool slidably accommodated in a sleeve. The sleeve is fixedly accommodated in a housing. The spool comprises opposing first and second ends. The first end comprises a first actuator pin; the second end comprises a second actuator pin. The sleeve and the spool are disposed between opposing first and second end caps. The first end cap comprises an aperture for receiving the first actuator pin; the second end cap comprises an aperture for receiving the second actuator pin. The first end cap is connected to a first proximity sensor; the second end cap is connected to a second proximity sensor. The first and second proximity sensors are connected electrically to electronic monitoring equipment.

In an embodiment, the present invention provides a fluid powered diaphragm pump that comprises a first diaphragm assembly and a second diaphragm assembly. The first and second diaphragm assemblies are connected by a diaphragm rod. The pump further comprises a fluid inlet providing communication between a pressurized fluid supply and both a main fluid valve and a pilot valve. The main fluid valve comprises a spool slidably accommodated in a housing. The spool is shiftable between a first main valve position and second main valve position. The spool further comprises a first end and a second end. The spool also comprises a first peripheral slot and a second peripheral slot. The first peripheral slot providing communication between the fluid inlet and the first diaphragm chamber when the spool is in the first main valve position; the second peripheral slot providing communication between the fluid inlet and the second diaphragm chamber when the spool is in the second main valve position. The pilot valve is shiftable between a first pilot position and a second pilot position. The pilot valve providing communication between the fluid inlet and the first end of the spool when the pilot valve is in the first pilot position to shift the spool to the first main valve position; the pilot valve providing communication between the fluid inlet and the second end of the spool when the pilot valve is in the second pilot position to shift the spool to the second main valve position. The pilot valve being shifted to the first pilot position by engagement with the first diaphragm assembly; the pilot valve being shifted to the second pilot position by engagement with the second diaphragm assembly. The pump also includes means for providing a supplemental pressurized fluid signal to the first end of the spool to further shift the spool to a first main valve position when the pilot valve is in the first pilot position and the pump further comprises means for providing a supplemental pressurized fluid signal to the second end of the spool to further shift the spool to the second main valve position when the pilot valve is in the second pilot position. The pilot valve is also disposed between the fluid inlet and the main fluid valve.

In an embodiment, the means for providing a supplemental pressurized fluid signal to either end of the main fluid valve spool comprises a cross porting or a cross-drilled passageway through the main fluid valve spool which will permit compressed air from one of the inner diaphragm chambers currently on the discharge stroke to bleed pressurized fluid into the end of the spool which currently has the pilot fluid signal behind it. As a result, pressurized fluid from the inner diaphragm chamber currently on the discharge stroke is used to supplement the pilot valve signal. This supplemental fluid signal remains in effect after the pilot valve has shifted and caused the signal to be sent to the opposing end of the main fluid valve spool to cause the pump to shift in the opposite direction.

In an embodiment, the cross porting is disposed in the intermediate housing as opposed to the spool. Accordingly, cross-drilled passageways are provided in the intermediate housing which provides communication between the inner diaphragm chambers and the opposing ends of the main fluid valve spool.

In an embodiment, the cross porting is disposed in the air inlet cap or the pilot valve housing. As a result, pressurized fluids from the inner diaphragm chamber currently in the discharge stroke is communicated through the air inlet cap or pilot valve housing to the end of the spool having the pilot valve signal behind it.

It is therefore an advantage of the present invention to provide a fluid powered diaphragm pump with a main fluid valve assembly that is easy to service and provides faster and more efficient access to the main fluid valve spool.

Yet another advantage of the present invention is that it provides a fluid powered diaphragm pump that is less prone to stalling.

Another advantage of the present invention is that it provides a fluid powered diaphragm pump that is less prone to sticking.

Another advantage of the present invention is that it provides a fluid powered diaphragm pump that is easily interfaced with electronic monitoring equipment.

Still another advantage of the present invention is that it provides a fluid powered diaphragm pump that provides a reliable source of pressurized fluid to drive the pilot valve.

And another advantage of the present invention is that it provides an improved fluid powered diaphragm pump with an exhaust muffler that is integral with the main fluid valve housing.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 2:
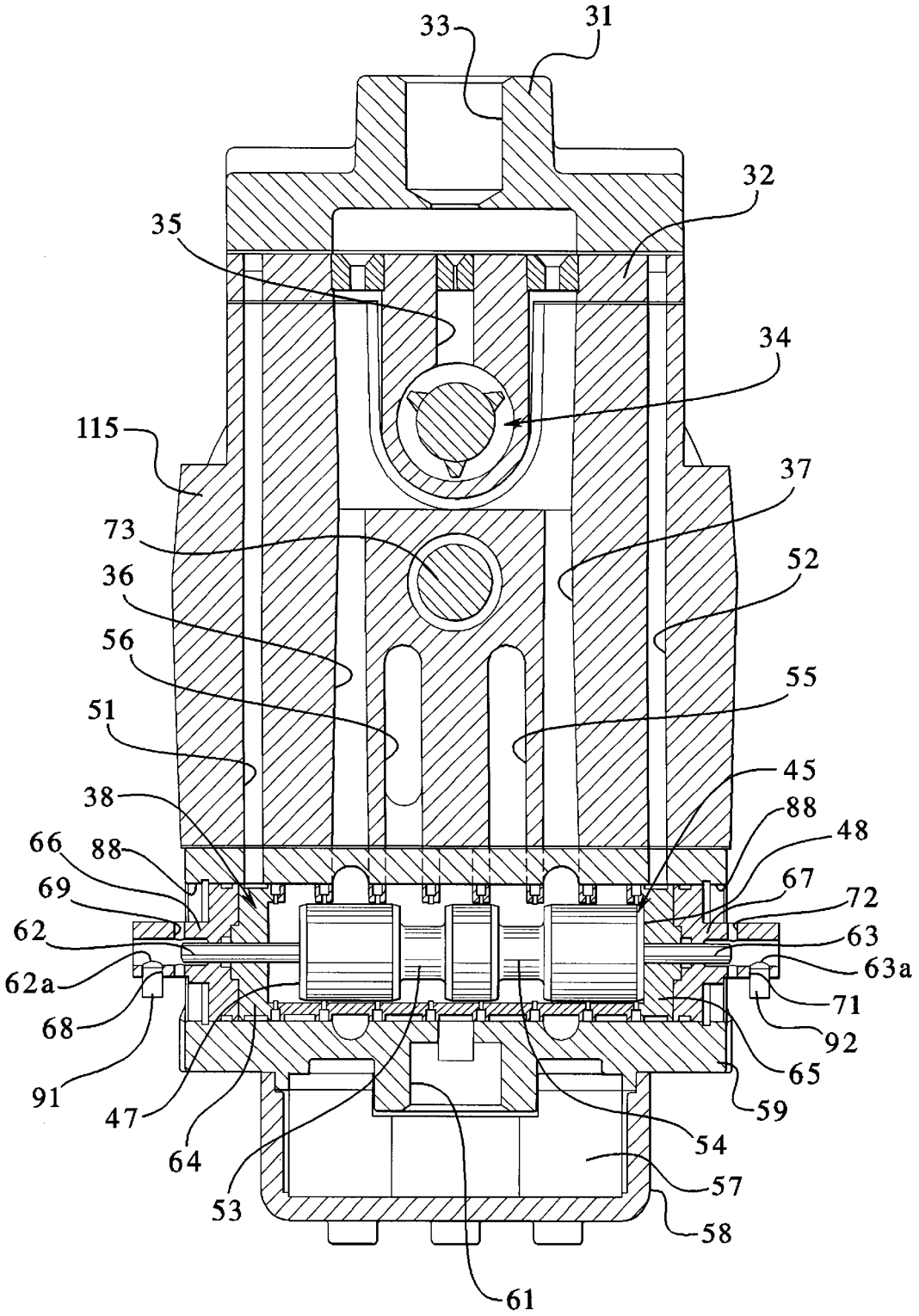
FIG. 2 is a sectional view of the air inlet cap, pilot valve assembly and main fluid valve assembly of a diaphragm pump made in accordance with the present invention, particularly illustrating the placement of the pilot valve directly underneath the air inlet cap.
Figure 3:
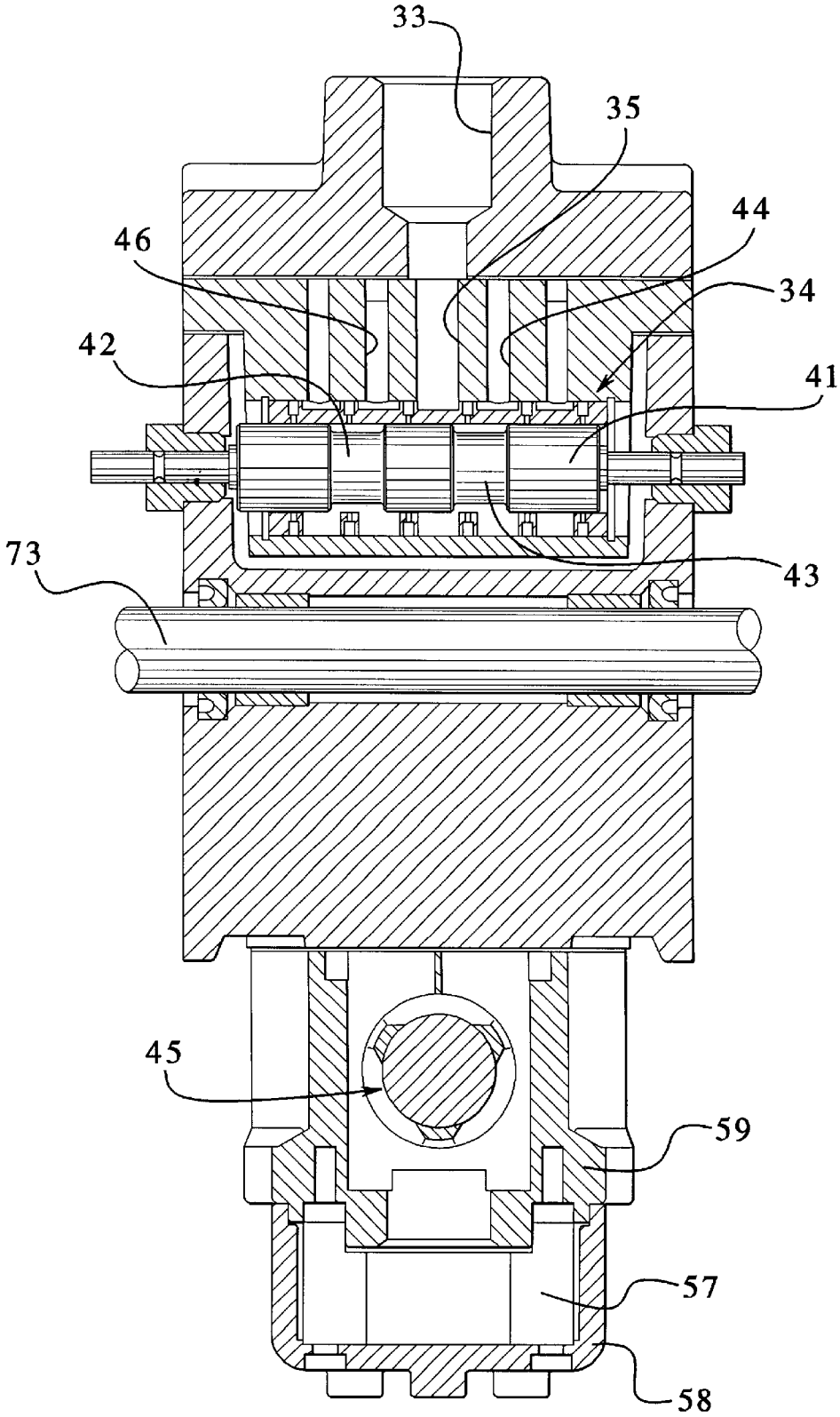
FIG. 3 is another sectional view of the air inlet cap, pilot valve assembly and main fluid valve assembly first shown in FIG. 2.

One important advantage provided by the fluid powered diaphragm pump design of the present invention is illustrated in FIGS. 2 and 3. Specifically, the air inlet cap housing 31 is attached to the top of the pilot valve housing 32. As a result, pressurized inlet fluid flows through the inlet passageway 33 directly to the pilot valve assembly 34 by way of the passageway 35 as shown in FIGS. 2 and 3. Fluid is also routed around the pilot valve assembly 34 and through the passageways 36, 37 (see FIG. 2) to the main fluid valve assembly 38. As a result, pressurized inlet fluid is supplied to the pilot valve assembly 34 and pressurized inlet fluid drives the pilot valve assembly 34 instead of a reliance upon a bleed supply as utilized by prior art pumps. Therefore, the fluid that drives the pilot valve assembly 34 is delivered at the same pressure as the fluid that flows through the main fluid valve assembly 38 and which drives the pump.

By way of background, the pilot valve assembly 34 includes a pilot valve spool 41 with two peripheral channels 42, 43. As shown in FIG. 3, the spool 41 is shifted to the left thereby exposing a portion of the peripheral channel 43 to the fluid being communicated downward through the passageway 35. Fluid is then routed around the spool 41 to the passageway 44 which, in turn, is in communication with one end of the main fluid valve spool 45. Similarly, when the pilot valve spool 41 is shifted to the right (not shown), the peripheral channel 42 will transmit pressurized fluid flowing through the passageway 35 to the passageway 46 which, in turn, will communicate the fluid to the opposing end of the main fluid valve spool 45. Thus, pressurized fluid communicated from the pilot valve assembly 34 to either end of the main fluid valve spool 45 shifts the main fluid valve spool 45 from left to right as shown in FIG. 2.

Figure 1:
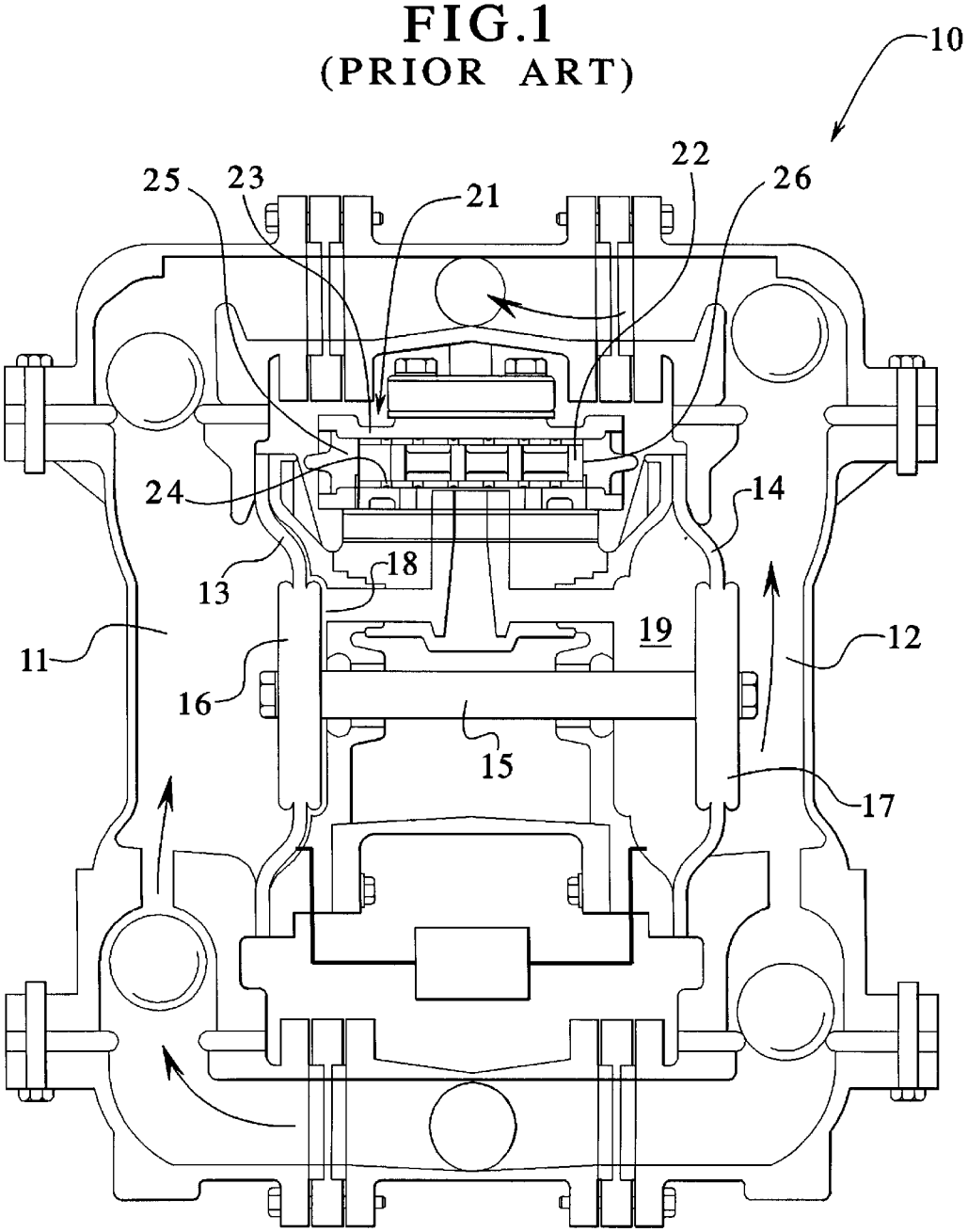
FIG.1 (PRIOR ART)
FIG. 1 is a schematic sectional plan view of a fluid powered diaphragm pump known in the art.

Returning to FIG. 2, the pressurized pilot signals are communicated to either end 47, 48 of the main fluid valve spool 45 by way of the passageways 51, 52 respectively. The main fluid valve spool 45, like the pilot valve spool 41, also includes peripheral slots or channels 53, 54. While the spool 45 is shifted to the right as shown in FIG. 2, pressurized fluid flows through the passageway 37 and around the peripheral channel 54 to the passageway 55 and onto one of the inner diaphragm pump chambers (see chambers 18, 19 as shown in FIG. 1). Similarly, when the spool 45 is shifted to the left (not shown in FIG. 2), air flowing through the passageway 36 will proceed through the peripheral channel 53 to the passageway 56 and onto one of the inner diaphragm chambers (see chambers 18, 19 of FIG. 1). The signal from the pilot valve assembly 34 to either end 47, 48 of the main fluid valve spool 45 results in the shifting of the spool 45 from the right position shown in FIG. 2 to a left position (not shown). Air is exhausted through the exhaust muffler 57 which is disposed between a muffler housing 58 and the main fluid valve body or housing 59. In the event the integral exhaust muffler shown in FIGS. 2 and 3 is not desired but, instead, the operator is required to pipe the exhaust fluid away, the main fluid valve housing 59 is equipped with a threaded port 61.

Also illustrated in FIG. 2 are the employment of actuator pins 62, 63 disposed at either ends 47, 48 of the main fluid valve spool 45. The actuator pins 62, 63 extend through the bumpers 64, 65 of the sleeve assembly which will be discussed in greater detail below with respect to FIG. 4. The actuator pins 62, 63 also extend into the apertures 62*a*, 63*a* of the end caps 66, 67 respectively. The end caps 66, 67 include two additional apertures each, shown at 68, 69 and 71, 72 respectively. The apertures 68, 71 in the end cap 66, 67 respectively accommodate proximity sensors which will be discussed in greater detail below with respect to FIGS. 6 and 7. The apertures 69, 72 in the end cap 66, 67 respectively accommodate safety clips, one of which is shown at 73*a* in FIG. 6. The safety clip 73*a* inserted into one of the apertures 69 or 72 prevents the main fluid valve spool 45 from shifting and effectively prevents any reciprocal movement of the pump or the diaphragm rod 73 (see also the rod 15 shown in FIG. 1).

Figure 4:
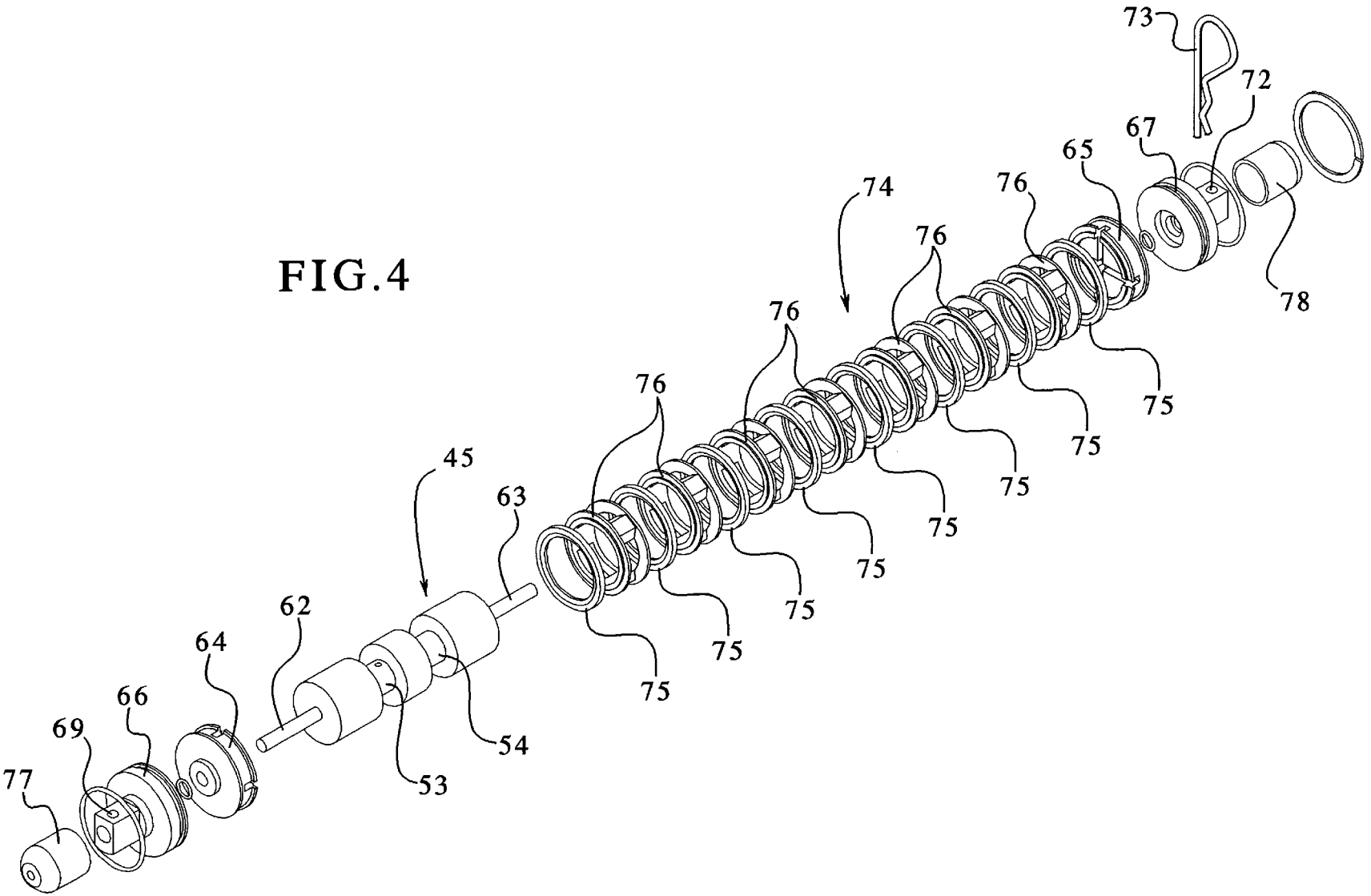
FIG. 4 is an exploded view of the main fluid valve spool, segmented sleeve assembly, end caps and safety clip of a main fluid valve assembly made in accordance with the present invention.

Also shown in FIG. 2 is the inclusion of a segmented sleeve assembly for accommodating the spool 45. The sleeve assembly is illustrated in greater detail at 74 in FIG. 4. Specifically, the sleeve assembly includes a plurality of wipers 75 with spacers 76 disposed between the wipers 75. By employing a segmented sleeve assembly 74, disassembly of the segmented sleeve assembly is facilitated in order to service the main fluid valve spool 45 in the event it sticks or becomes bound in the sleeve assembly 74. Also shown in FIG. 4 are protective caps 77, 78 which are employed in the event proximity sensors are not utilized.

Figure 5:
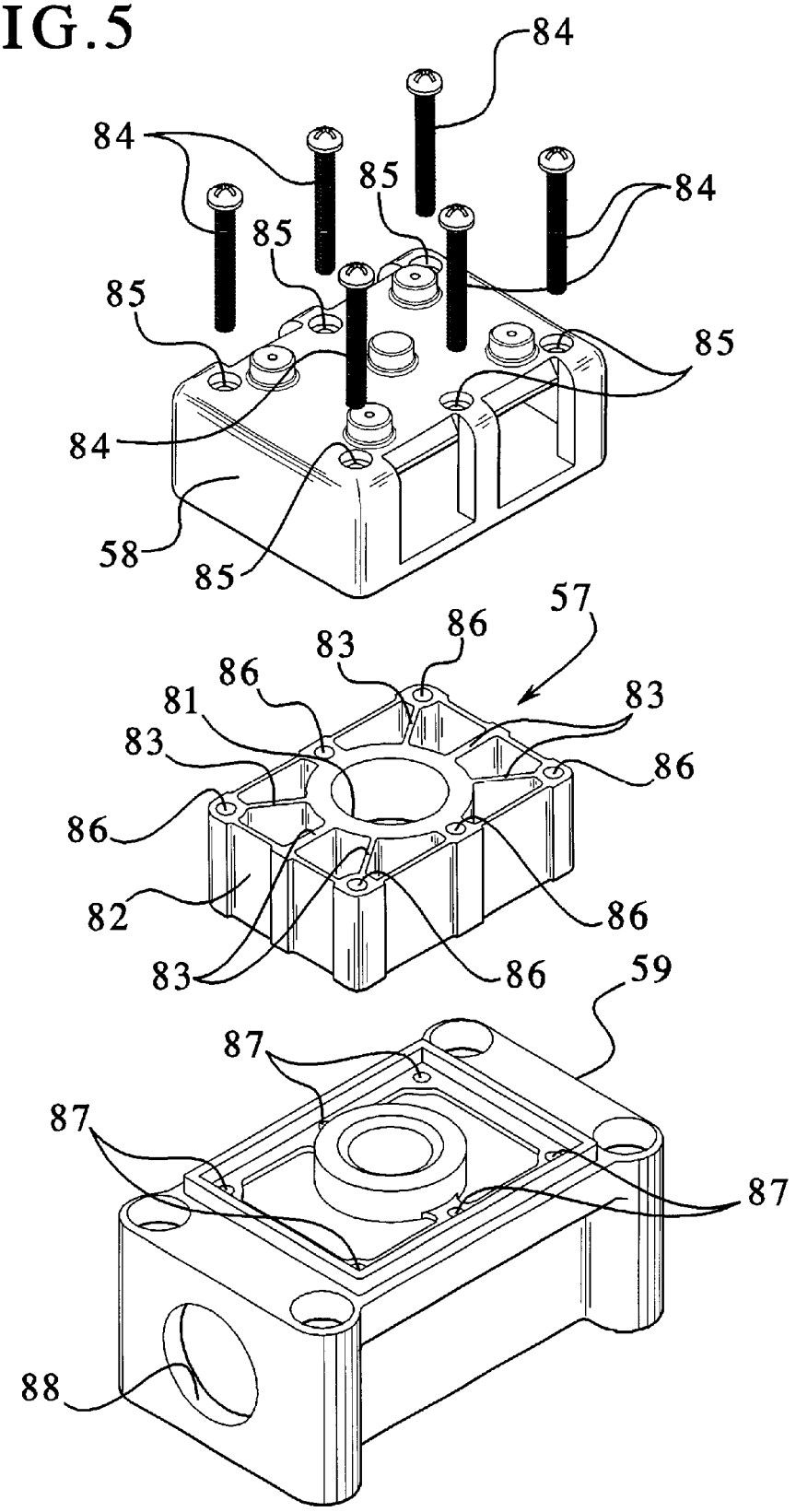
FIG. 5 is an exploded view of a main fluid valve housing, exhaust muffler and muffler housing that comprise the integral main fluid valve housing and exhaust muffler system made in accordance with the present invention.

Turning to FIG. 5, the exhaust muffler 57 is illustrated in greater detail. The muffler 57 includes a central aperture 81 which is connected to a surrounding outer wall 82 by a plurality of radially outwardly extending ribs shown generally at 83. The muffler 57 is enclosed by the housing 58 which is connected to the main fluid valve housing 59 by a plurality of bolts 84 that pass through holes 85 in the housing 58, holes 86 in the muffler 57 before engaging the threaded holes 87 in the main fluid valve housing 59. The openings 88 for accommodating the end caps 66, 67 are shown in FIGS. 2, 5 and 6.

Figure 6:
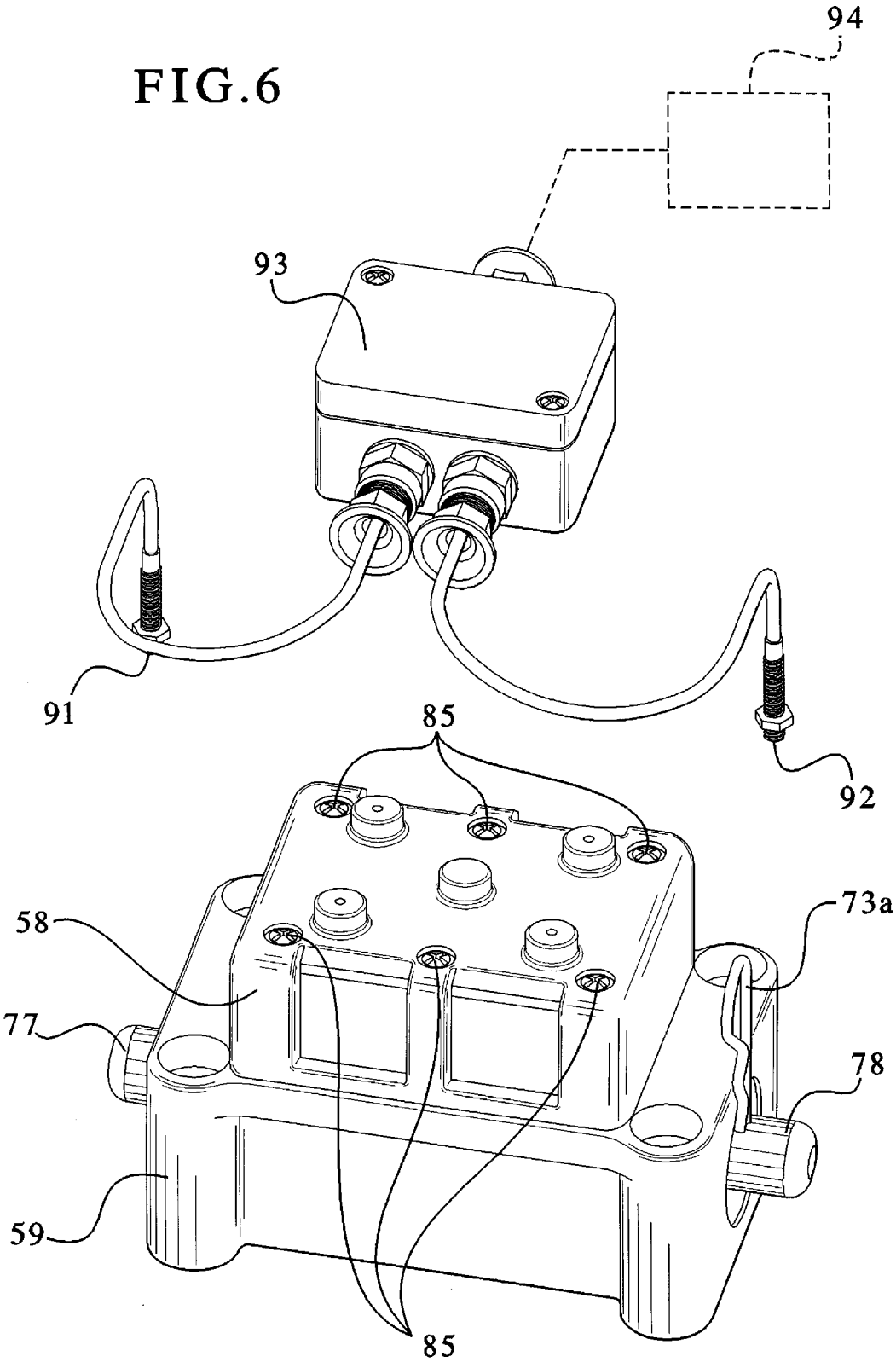
FIG. 6 is an exploded view of the integral exhaust muffler and main fluid valve housing shown in FIG. 5 with a pulse output interface connection made in accordance with the present invention.

Turning to FIG. 6, proximity sensors are shown at 91, 92. As discussed above with respect to FIG. 2, the proximity sensors 91, 92 are received in the openings 68, 71 of the end caps 66, 67 respectively. The proximity sensors 91, 92 are connected to an electrical interface 93 which, in turn, is connected to a controller 94 or other electronic monitoring equipment. The interface 93 is compact and easily added to the modified pump of the present invention or can be easily removed if not needed.

Figure 7:
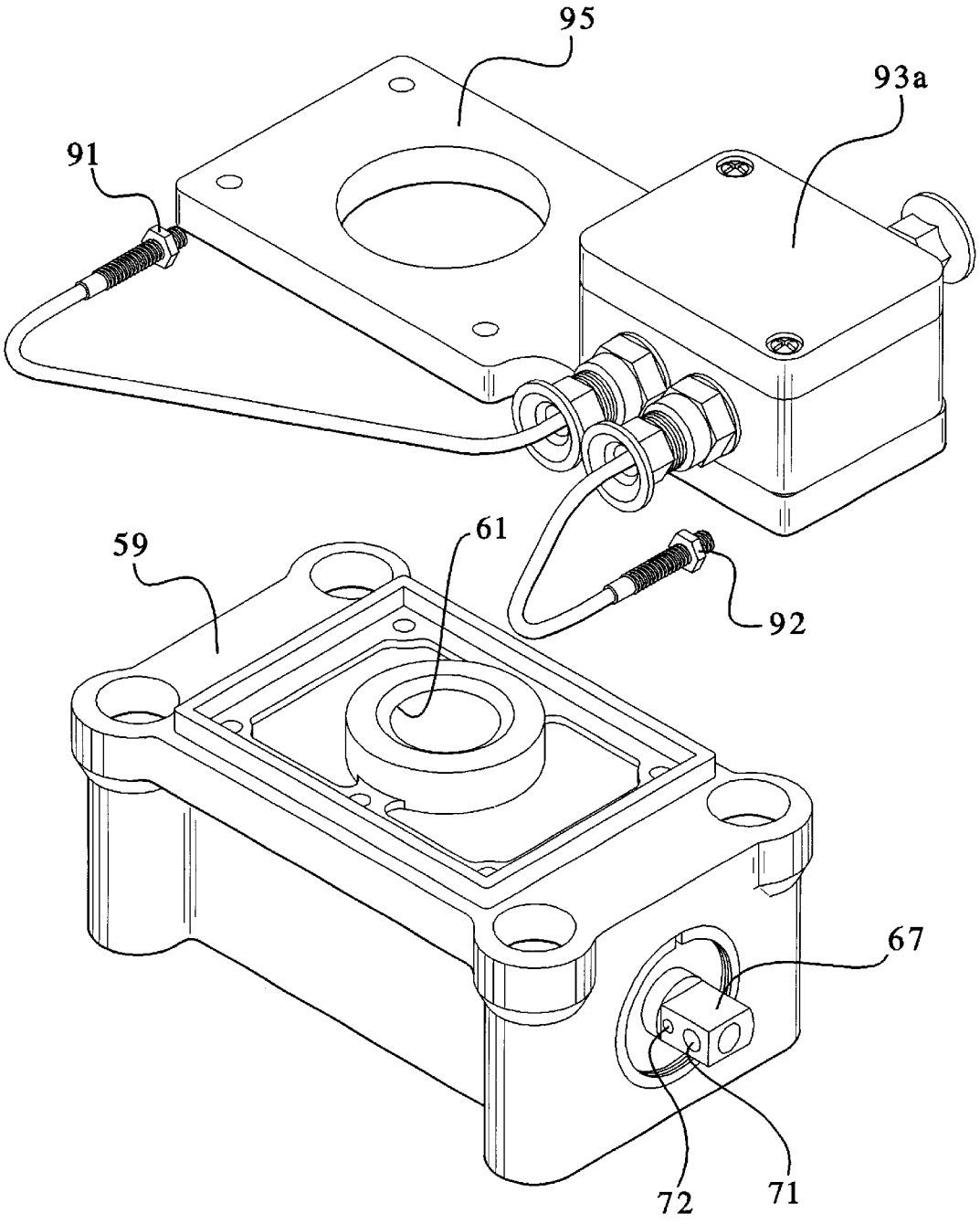
FIG. 7 is an exploded view of a main fluid valve housing and pulse output interface connection made in accordance with the present invention.

An alternative embodiment is shown in FIG. 7 whereby the interface 93*a* is mounted to a plate 95 which, in turn, is mounted to the main fluid valve housing 59 without an integral muffler 57 and housing 58 as shown in FIGS. 5 and 6. In the embodiment shown in FIG. 7, the threaded port 61 can be connected to piping for disposing of the exhaust fluid.

Figure 8:
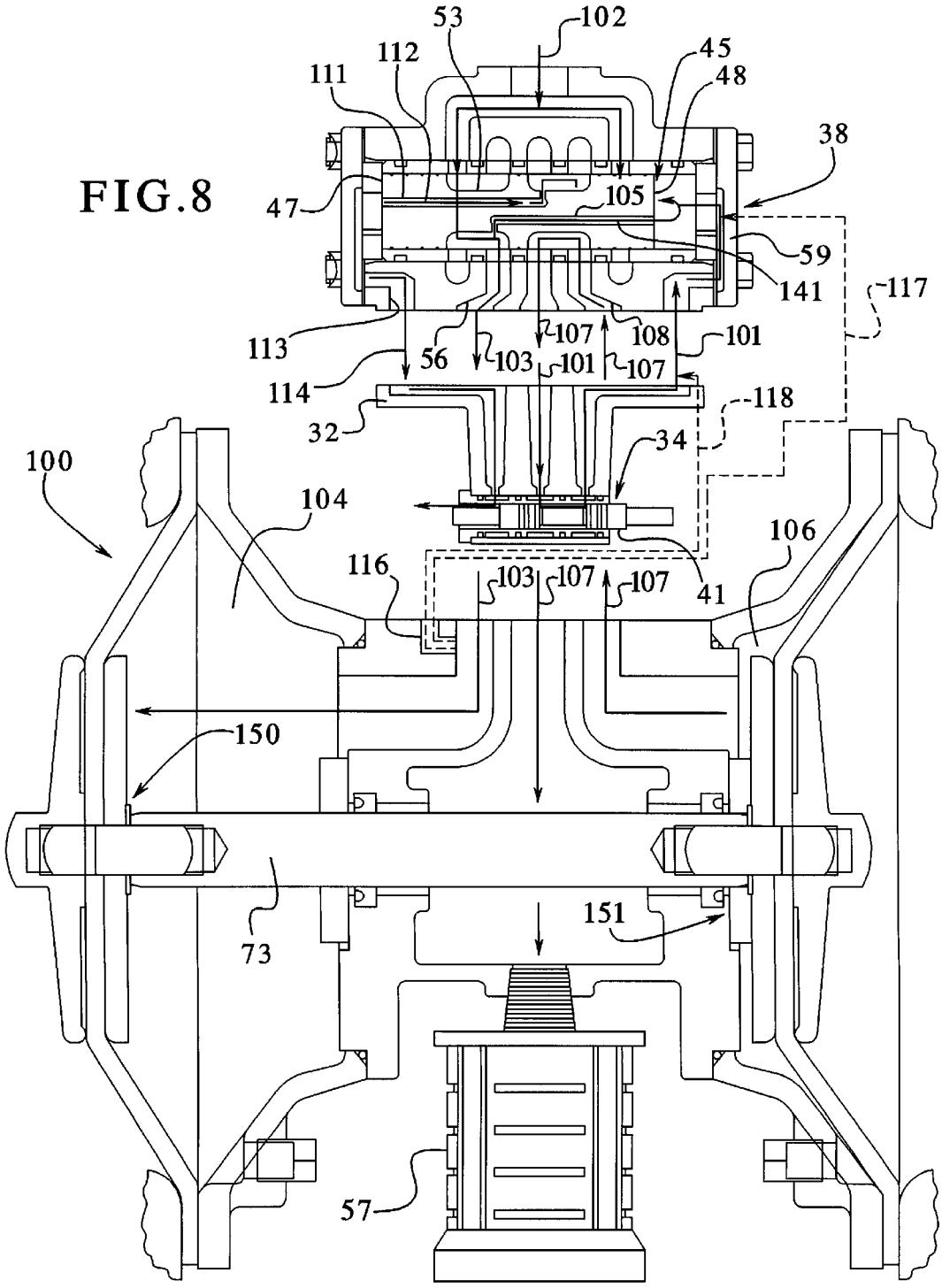
FIG. 8 is a schematic illustration of a main fluid valve assembly, pilot valve assembly and diaphragm pump chambers made in accordance with the present invention, particularly illustrating the means for cross porting pressurized fluid to the end of the main fluid valve spool to which the pilot valve signal is being applied.
Figure 9:
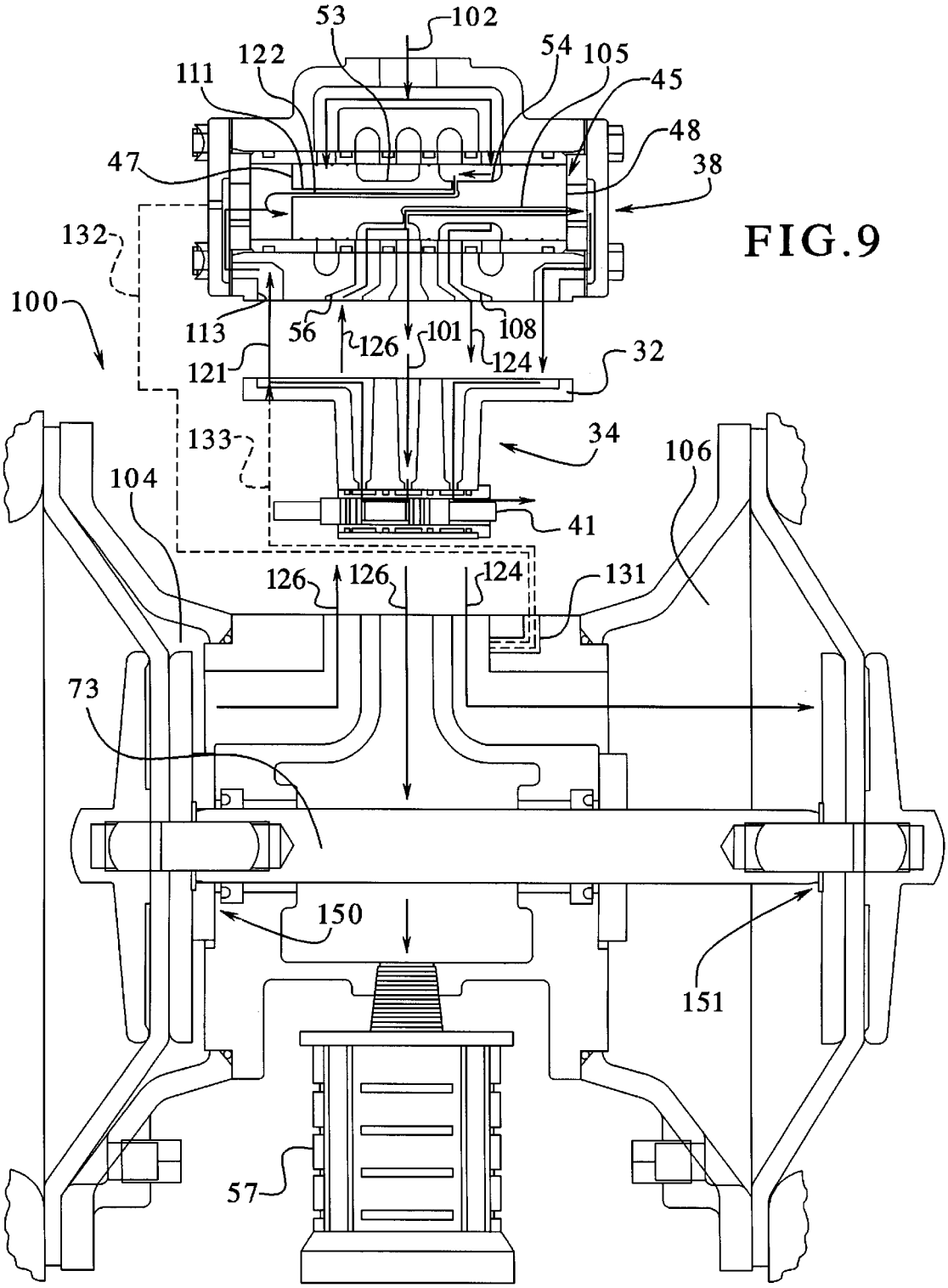
FIG. 9 is another schematic illustration of a main fluid valve assembly, pilot valve assembly and diaphragm pump chambers made in accordance with the present invention, particularly illustrating the means for cross porting pressurized fluid to the end of the main fluid valve spool to which the pilot valve signal is being applied.

Turning to FIGS. 8 and 9, two diaphragm assemblies 150, 151 are connected by the diaphragm rod 73, and the air detent or cross porting features of the present invention are illustrated schematically. Specifically, referring to FIG. 8, pressurized fluid enters the pilot valve assembly 34 and main fluid valve assembly 38 as indicated by the lines 101, 102 respectively. With the pilot valve spool 41 shifted to the right as shown in FIG. 8, the pressurized fluid is routed through the pilot valve housing 32 and through the main fluid valve housing 59 to apply a pilot signal to the right end 48 of the main fluid valve spool 45. Because the application of a pilot valve signal to the end 48 of the spool 45 may not be sufficient to shift the main fluid valve spool 45 to the left completely as shown in FIG. 8, the present invention provides a number of means for applying a supplemental signal to the right end 48 of the spool 45 to ensure that a complete shift is accomplished. Specifically, three separate means are illustrated in FIGS. 8 and 9.

First, still referring to FIG. 8, it will be noted that the pressurized fluid flowing through the main fluid valve assembly 38 flows around the peripheral groove 53 and out the passageway 56 as indicated by the broken line 103 to the left inner diaphragm chamber 104. However, a portion of the pressurized fluid signal flowing around the peripheral groove 53 is communicated by way of the passageway 105 to the right end 48 of the spool 45 to serve as a supplemental pilot signal in addition to the signal delivered via the pilot valve assembly 34. The supplemental signal ensures that a quick, positive shift of the spool 45 takes place. The exhaust fluid from the right diaphragm chamber 106 is indicated as the broken line 107 and proceeds through the passageway 108 of the main fluid valve housing 59 to the exhaust muffler 57. Fluid from the left end 47 of the spool 45 is similarly exhausted by way of the passageway 111 as indicated by the line 112 as well as by way of the passageway 113 as indicated by the line 114.

In addition to the cross-porting of the main fluid valve spool 45 as discussed above, two other means for supplementing the pilot valve signal are illustrated schematically in FIG. 8. Specifically, a cross porting through the intermediate bracket 115 (see FIGS. 2 and 3) that connects the main fluid valve assembly to the pilot valve assembly 34 can be performed which will route pressurized fluid (see the line 103 entering the inner diaphragm chamber 104) through a passageway 116 to the right side 48 of the spool 45 as indicated by the dotted line 117. Similarly, pressurized fluid may also be routed through the passageway 116 as indicated by the broken line 118 to supplement the pilot valve signal shown at 101.

Similarly, referring to FIG. 9, pressurized fluid is still being supplied to the pilot valve assembly 34 as shown by the line 101 and to the main fluid valve assembly 38 as shown by the line 102. However, the pilot valve spool 41 has been shifted to the right so that the pressurized fluid line 101 is being directed to the left side 47 of the main fluid valve spool 45 as indicated by the line 121. In order to supplement this signal, pressurized fluid is directed through the passageway 111 as indicated by the line 122 to supplement the pilot signal at the left side 47 of the main fluid valve spool 45. The main portion of the pressurized fluid supply 102 proceeds around the peripheral channel 54, through the passageway 108 as indicated by the broken line 124 to the right inner diaphragm chamber 106. Pressurized fluid is exhausted from the left inner diaphragm chamber 104 as indicated by the broken line 126 up through the passageway 56 and through the muffler 57.

Again, pressurized fluid flowing into the right inner chamber 106 may be tapped or bled off by way of a passageway 131 for purposes of supplementing the pilot signal at the left side 147 of the main fluid valve spool 45. The supplemental signal may be routed through the intermediate bracket as indicated by the line 132 to the left side of the main fluid valve assembly 38. In the alternative, the supplemental signal may be routed through the pilot valve housing 32 as indicated by the line 133. Thus, three separate means for supplementing the pilot valve signal are illustrated in FIGS. 8 and 9.

Figure 10:
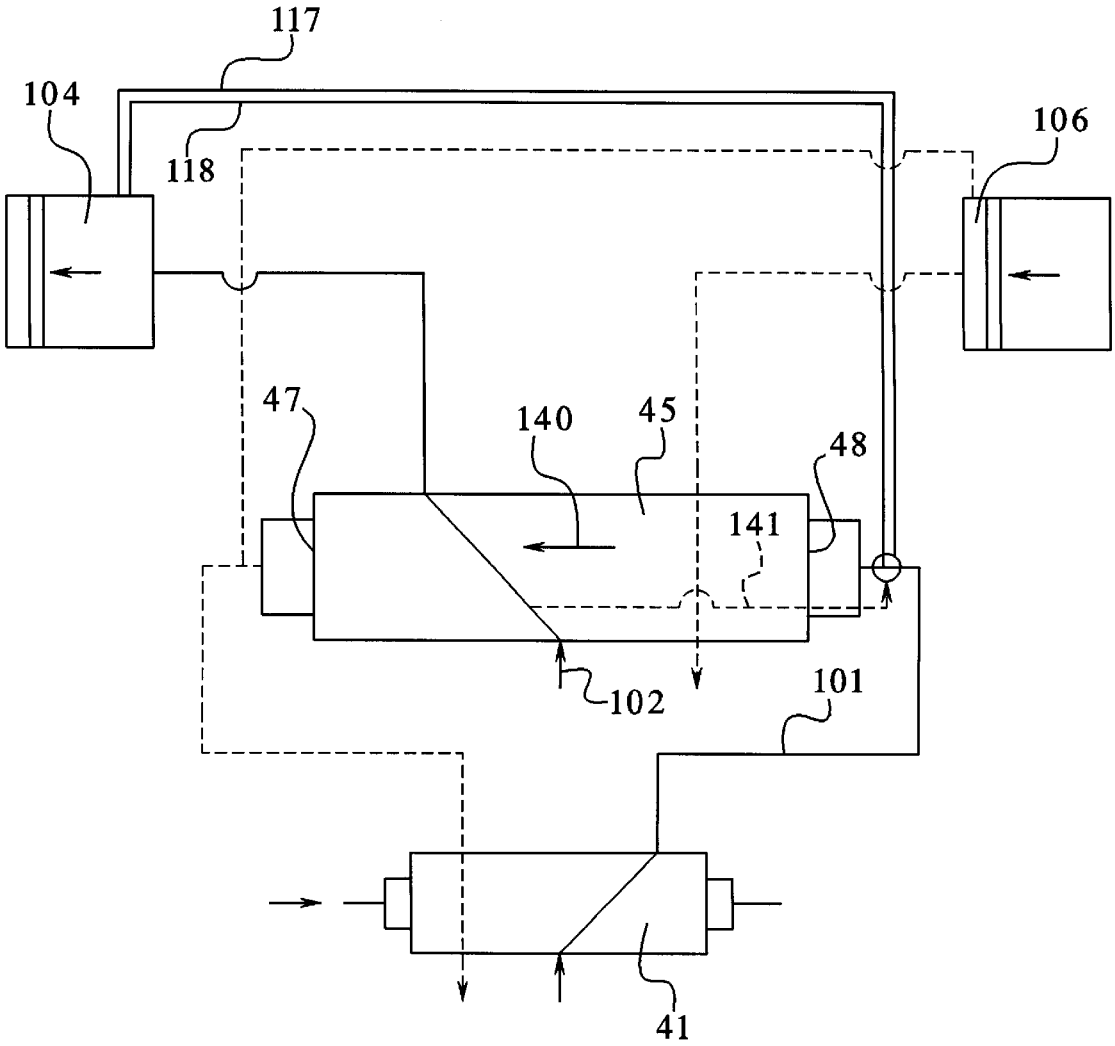
FIG. 10 is a schematic illustration of the means for supplying an additional pressurized fluid signal to the end of the main fluid valve spool to which the pilot signal is being applied.
Figure 11:
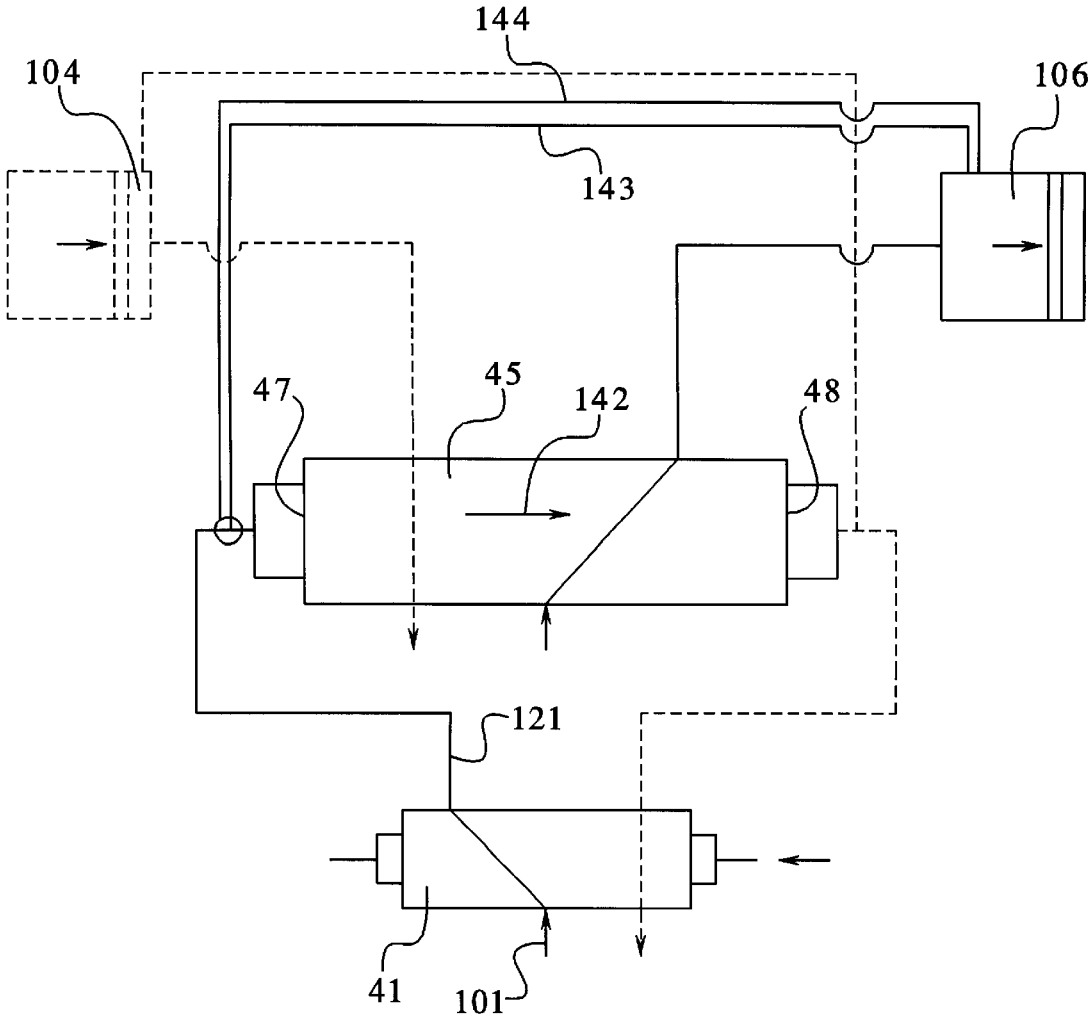
FIG. 11 is another schematic illustration of the means for supplying an additional pressurized fluid signal to the end of the main fluid valve spool to which the pilot signal is being applied.

Turning to FIGS. 10 and 11, three means for supplementing the pilot valve signal are illustrated again schematically. First, as shown in FIG. 10, a pilot signal is being applied to the right end 48 of the spool 45 to shift the spool 45 to the left as indicated by the arrow 140. The pilot signal is shown at 101 which is routed through the pilot valve spool 41. To supplement the pilot signal 101, pressurized fluid may be routed through the spool 45 as indicated by the line 141 (see also the passageway 105 as shown in FIG. 8), or a supplemental signal may be tapped or bled from the left diaphragm inner chamber 104 by way of a passageway that proceeds through the pilot valve housing 32 (not shown in FIG. 10) as indicated by the line 118 or through the intermediate bracket 115 (also not shown in FIG. 10) as indicated by the line 117. Similarly, in FIG. 11, a pilot valve signal is being applied to the left end 47 of the spool 45 to shift the spool to the right as indicated by the arrow 142. The pilot signal is shown by the line 121 which passes through the pilot valve spool 41. The pilot signal 121 can be supplemented by bleeding or tapping off pressurized fluid from the right inner diaphragm chamber 106 either through the intermediate casing 115 (not shown) or through the pilot valve housing 32 (also not shown in FIG. 11) as indicated by the lines 143,144.

Accordingly, an improved fluid powered diaphragm pump is provided which includes a number of advantages over those pumps known in the art. Specifically, three different ways for supplementing the pilot valve signal are provided. Further, an intermediate casing is provided whereby the pilot valve assembly is disposed immediately under the air inlet cap so that the pilot valve spool is driven by fluid at the same pressure that is used to drive the pump. Thus, problems associated with low pressurized fluid being used to shift the pilot valve are avoided. Further, a segmented sleeve assembly is provided which makes it easier to service the main fluid valve spool and main fluid valve assembly. Further, an integrated exhaust and muffler assembly are provided that are mounted directly to the main fluid valve housing. Further, a pulse output interface can be easily attached to the main fluid valve assembly to integrate the pump with electronic manufacturing and monitoring equipment.

From the above description it is apparent that the objets of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A fluid powered diaphragm pump comprising:

a fluid inlet providing communication between a pressurized fluid supply and both a main fluid valve and a pilot valve, the main fluid valve comprising a housing, the pilot valve being disposed between the fluid inlet and the main fluid valve and the pilot valve being in direct communication with the fluid inlet said pump having a diaphragm dividing a diaphragm chamber, the main fluid valve having an outlet to one side of the chamber, the pilot valve having fluid outlets to the main valve effective to control movement of the main valve.

2. The pump of claim 1 wherein the main fluid valve comprises a spool slidably accommodated in a segmented sleeve assembly, the segmented sleeve assembly comprising a plurality of annular sleeve segments, the annular sleeve segments being fixedly accommodated in the housing.

3. The pump of claim 2 wherein the segmented sleeve assembly further comprises a plurality of spacers, each spacer being disposed between two of the annular sleeve segments.

4. The pump of claim 2 wherein the spool comprises opposing first and second ends, the first end comprising a first actuator pin, the second end comprising a second actuator pin, the annular sleeve segments and the spool are disposed between opposing first and second end caps, the first end cap comprising an aperture for receiving the first actuator pin, the second end cap comprising an aperture for receiving the second actuator pin, the first end cap being connected to a first proximity sensor, the second end cap being connected to a second proximity sensor, the first and second proximity sensors being connected to a controller, the spool being shiftable between a first main valve position where the first actuator pin extends through the aperture of the first end cap and past the first proximity sensor and a second main valve position where the second actuator pin extends through the aperture of the second end cap and past the second proximity sensor, the sensors providing an input to the controller indicating the frequency at which the first actuator pin extends past the first proximity sensor and the frequency at which the second actuator pin extends past the second proximity sensor.

5. The pump of claim 1 wherein the housing comprises a threaded exhaust port, the threaded exhaust port being connected to an exhaust muffler, the exhaust muffler being disposed between and enclosed by the main fluid valve housing and a muffler housing, the muffler housing is connected to the main fluid valve housing.

6. A fluid powered diaphragm pump comprising:

a fluid inlet providing direct communication between a pressurized fluid supply and both a main fluid valve and a pilot valve, the main fluid valve comprising a spool slidably accommodated in a segmented sleeve assembly, the segmented sleeve assembly comprising a plurality of annular sleeve segments, the annular sleeve segments being fixedly accommodated in a housing, the spool comprising opposing first and second ends, the first end comprising a first actuator pin, the second end comprising a second actuator pin, the sleeve segments and the spool are disposed between opposing first and second end caps, the first end cap comprising an aperture for receiving the first actuator pin, the second end cap comprising an aperture for receiving the second actuator pin, the first end cap being connected to a first proximity sensor, the second end cap being connected to a second proximity sensor, the first and second proximity sensors being connected to a controller, the spool being shiftable between a first main valve position where the first actuator pin extends through the aperture of the first end cap and past the first proximity sensor and a second main valve position where the second actuator pins extends through the aperture of the second end cap and past the second proximity sensor, the sensors providing an input to the controller indicating the frequency at which the first actuator pin extends past the first proximity sensor and the frequency at which the second actuator pin extends past the second proximity sensor.

7. The pump of claim 6 further comprising a plurality of spacers, each spacer being disposed between two of the annular sleeve segments.

8. The pump of claim 6 wherein the pilot valve is disposed between the fluid inlet and the main fluid valve.

9. The pump of claim 6 wherein the housing comprises a threaded exhaust port, the threaded exhaust port being connected to an exhaust muffler, the exhaust muffler being disposed between and enclosed by the main fluid valve housing and a muffler housing, the muffler housing is connected to the main fluid valve housing.

10. A fluid powered diaphragm pump comprising:

a fluid inlet providing direct communication between a pressurized fluid supply and both a main fluid valve and a pilot valve, the main fluid valve comprising a housing, the pilot valve being disposed between the fluid inlet and the housing, the housing comprising a threaded exhaust port, the threaded exhaust port being connected to an exhaust muffler, the exhaust muffler being disposed between and enclosed by the main fluid valve housing and a muffler housing, the muffler housing is connected to the main fluid valve housing, the main fluid valve comprising a spool slidably accommodated in a segmented sleeve assembly, the segmented sleeve assembly comprising a plurality of annular sleeve segments, the annular sleeve segments being fixedly accommodated in a housing, the spool comprising opposing first and second ends, the first end comprising a first actuator pin, the second end comprising a second actuator pin, the annular sleeve segments and the spool being disposed between opposing first and second end caps, the first end cap comprising an aperture for receiving the first actuator pin, the second end cap comprising an aperture for receiving the second actuator pin, the first end cap being connected to a first proximity sensor, the second end cap being connected to a second proximity sensor, the first and second proximity sensors being connected to a controller, the spool being shiftable between a first main valve position where the first actuator pin extends through the aperture of the first end cap and past the first proximity sensor and a second main valve position where the second actuator pin extends through the aperture of the second end cap and past the second proximity sensor, the sensors providing an input to the controller indicating the frequency at which the first actuator pin extends past the first proximity sensor and the frequency at which the second actuator pin extends past the second proximity sensor.

11. The pump of claim 10 wherein the segmented sleeve assembly further comprises a plurality of spacers, each spacer being disposed between two of the annular sleeve segments.

12. The pump of claim 10 wherein the pilot valve is disposed between the fluid inlet and the main fluid valve.

13. A fluid powered diaphragm pump comprising:

a fluid inlet providing direct communication between a pressurized fluid supply and both a main fluid valve and a pilot valve, the main fluid valve comprising a spool slidably accommodated in a sleeve, the sleeve being fixedly accommodated in a housing, the spool comprising opposing first and second ends, the first end comprising a first actuator pin, the second end comprising a second actuator pin, the sleeve and the spool being disposed between opposing first and second end caps, the first end cap comprising an aperture for receiving the first actuator pin, the second end cap comprising an aperture for receiving the second actuator pin, the first end cap being connected to a first proximity sensor, the second end cap being connected to a second proximity sensor, the first and second proximity sensors being connected to a controller.

14. The pump of claim 13 wherein the sleeve comprises a plurality of annular sleeve segments.

15. The pump of claim 14 wherein the segmented sleeve assembly further comprises a plurality of spacers, each spacer being disposed between two of the annular sleeve segments.

16. The pump of claim 13 wherein the pilot valve is disposed between the fluid inlet and the main fluid valve.

17. The pump of claim 13 wherein the spool is shiftable between a first main valve position where the first actuator pin extends through the aperture of the first end cap and past the first proximity sensor and a second main valve position where the second actuator pin extends through the aperture of the second end cap and past the second proximity sensor, the sensors providing an input to the controller indicating the frequency at which the first actuator pin extends past the first proximity sensor and the frequency at which the second actuator pin extends past the second proximity sensor.

18. The pump of claim 13 wherein the housing comprises a threaded exhaust port, the threaded exhaust port being connected to an exhaust muffler, the exhaust muffler being disposed between and enclosed by the main fluid valve housing and a muffler housing, the muffler housing is connected to the main fluid valve housing.

19. A fluid powered diaphragm pump comprising:

a first diaphragm assembly and a second diaphragm assembly, the first and second diaphragm assemblies being connected by a diaphragm rod, the first and second diaphragm assemblies defining first and second diaphragm chambers respectively, the pump further comprises a fluid inlet providing communication between a pressurized fluid supply and both a main fluid valve and a pilot valve, the main fluid valve comprising a spool slidably accommodated in a housing, the spool being shiftable between a first main valve position and a second main valve position, the spool comprising a first end and a second end, the spool further comprising first and second peripheral slots, the first peripheral slot providing communication between the fluid inlet and the first diaphragm chamber when the spool is in the first main valve position, the second peripheral slot providing communication between the fluid inlet and the second diaphragm chamber when the spool is in the second main valve position, the pilot valve being shiftable between a first pilot position and a second pilot position, the pilot valve providing communication between the fluid inlet and the first end of the spool when the pilot valve is in the first pilot position to shift the spool to the first main valve position, the pilot valve providing communication between the fluid inlet and the second end of the spool when the pilot valve is in the second pilot position to shift the spool to the second main valve position, the pilot valve being shifted to the first pilot position by engagement with the first diaphragm assembly, the pilot valve being shifted to the second pilot position by engagement with the second diaphragm assembly, means for providing a supplemental pressurized fluid signal to the first end of the spool to further shift the spool to the first main valve position when the pilot valve is in the first pilot position, means for providing a supplemental pressurized fluid signal to the second end of the spool to further shift the spool to the second main valve position when the pilot valve is in the second pilot position, the pilot valve being disposed between the fluid inlet and the main fluid valve, the pilot valve being in direct communication with the air inlet.

20. The pump of claim 19 wherein the spool is slidably accommodated in a segmented sleeve assembly, the segmented sleeve assembly comprising a plurality of annular sleeve segments, the annular sleeve segments being fixedly accommodated in a housing.

21. The pump of claim 19 wherein the housing comprises a threaded exhaust port, the threaded exhaust port being connected to an exhaust muffler, the exhaust muffler being disposed between and enclosed by the main fluid valve housing and a muffler housing, the muffler housing is connected to the main fluid valve housing.

22. The pump of claim 19 wherein the spool is slidably accommodated in a sleeve, the sleeve being fixedly accommodated in a housing, the spool comprising opposing first and second ends, the first end comprising a first actuator pin, the second end comprising a second actuator pin, the sleeve and the spool being disposed between opposing first and second end caps, the first end cap comprising an aperture for receiving the first actuator pin, the second end cap comprising an aperture for receiving the second actuator pin, the first end cap being connected to a first proximity sensor, the second end cap being connected to a second proximity sensor, the first and second proximity sensors being connected to a controller.

* * * * *